US006474506B2

(12) United States Patent
Mawby et al.

(10) Patent No.: US 6,474,506 B2
(45) Date of Patent: Nov. 5, 2002

(54) DISPENSING CONTAINER

(76) Inventors: Gary Mawby, 10700 Amber Ridge Dr., #104, Las Vegas, NV (US) 89144; Kenneth Kroll, 10700 Amber Ridge Dr., #104, Las Vegas, NV (US) 89144

( * ) Notice: Subject to any disclaimer, the term of this patent is extended or adjusted under 35 U.S.C. 154(b) by 0 days.

(21) Appl. No.: 09/769,041

(22) Filed: Jan. 24, 2001

(65) Prior Publication Data

US 2001/0035427 A1 Nov. 1, 2001

Related U.S. Application Data

(60) Provisional application No. 60/243,929, filed on Oct. 27, 2000, and provisional application No. 60/203,977, filed on May 12, 2000.

(51) Int. Cl.[7] ..... B67D 5/00

(52) U.S. Cl. ..... 222/78; 222/83; 222/541.2; 222/541.6; 215/6; 220/277

(58) Field of Search ..... 215/6; 220/277; 222/78, 83, 87, 541.1, 541.2, 541.3, 541.4, 541.6; 401/134, 139

(56) References Cited

U.S. PATENT DOCUMENTS 2,005,642 A * 6/1935 Thornton ..... 221/60
5,042,690 A * 8/1991 O'Meara ..... 222/83
5,255,812 A * 10/1993 Hsu ..... 220/277
5,482,176 A * 1/1996 Maietta et al. ..... 220/277
5,850,945 A * 12/1998 Frankel ..... 222/212
5,992,668 A * 11/1999 Elliatt ..... 220/278

* cited by examiner

*Primary Examiner*—Lesley D. Morris
*Assistant Examiner*—Melvin A. Cartagena
(74) *Attorney, Agent, or Firm*—Robert Ryan Morishita; Anderson & Morishita

(57) ABSTRACT

A dispensing container includes container walls formed from a stiff deformable material to define a shell enclosing a chamber. A small dispensing opening provides access to the chamber. Optionally, the container has a separate fill opening. A protective cap covers the dispensing opening. Optionally, the cap forms an air pocket over the dispensing opening. In use, the cap is ruptured by tearing the cap or by applying pressure to the cap to burst the air pocket. The container may additionally include a thin film between the cap and the dispensing opening to prevent leakage when the cap is ruptured. The thin film is ruptured by applying pressure to the container contents by squeezing the container. Alternatively, a tooth is disposed between the cap and the film such that displacement of the cap causes the tooth to rupture the film.

19 Claims, 3 Drawing Sheets

DISPENSING CONTAINER

RELATED APPLICATION DATA

The present application claims the priority of Provisional Application Serial No. 60/203,977 filed May 12, 2000 and entitled "Dispensing Container" and Provisional Application Serial No. 60/243,929 filed Oct. 27, 2000 and entitled "Dispensing Container" by Applicant herein.

FIELD OF THE INVENTION

The present invention relates to dispensing containers. Specifically, the present invention is a dispensing container that may be used to dispense material including fluids, pastes, sprays, powders, solids, or the like.

BACKGROUND OF THE INVENTION

Many materials are held and contained in dispensing containers. For example, foodstuffs, such as creamers, ketchup, and the like, are often contained in containers that serve many purposes. First, the container serves to hold and contain a fluid or diffuse material. Second, the container serves as a measurement of a single serving. Third, the container serves as a dispenser to dispense the material as desired. The challenge, then, is to provide an easily opened container that performs these functions while being leak-proof and impervious to bacteria and other contaminants.

Many dispensing containers are known in the prior art. For example, one dispensing container in the prior art is a squeezable packet used to dispense paste-like materials such as ketchup, toothpaste, and the like. Such packets are formed from a plastic sheet or a metal foil laminated with plastic. The packet is sealed around its perimeter and includes a notch or weakened portion at one point along its perimeter. The packet is opened by breaking the seal by tearing the packet at the notch. The contents are then squeezed from the packet.

A major drawback of such packets is that the packet often does not tear uniformly. Thus, it can be difficult to control or predict the size and location of the opening. Often, an opening is created that is too large, too small, or not in a convenient location along the packet. Alternatively, if the notch is absent or, if present, is not deep enough, the packet is difficult to open because of its plastic or foil-plastic construction. Another drawback is that these packets are difficult to open without applying pressure to the packet contents. Thus, these packets may eject the contents as the seal is broken, again creating a mess.

Another type of well known liquid dispensing container includes a small, frustoconical or cylindrical cup closed, typically using adhesive, with a removable paper or plastic lid attached along the cup's brim. The dispensing container is opened by grasping a tab connected to the lid and peeling the lid from the cup thereby breaking the seal and exposing the contents of the cup. The contents may be poured from the cup. Additionally, a spout may be provided somewhere along the brim of the cup to facilitate pouring.

However, these containers have drawbacks. One drawback is that it is difficult to measure out less than a single serving. That is, if one does not wish to use the entire serving of liquid, one must carefully pour the desired amount from the cup. Similarly, the contents cannot be squeezed from the container with any amount of pressure to create a stream of liquid that may be advantageous for a variety of reasons. For example, with creamer the ability to create a stream of liquid aids in mixing the creamer with the coffee and creating a frothy texture on the surface of the coffee. In the dispensing container of the prior art, however, the contents must be poured from the container. Also, the small tab connected to the lid may be difficult to grasp. Even when grasped, the size of the tab often makes it difficult to apply the necessary amount of force to peel the lid from the cup. Similarly, when the tab is pulled, the lid may not peel uniformly or the lid may tear. Another drawback of such containers is that opening the container requires the use of two hands.

Interestingly, such dispensing containers, whether they be of the packet design or of the sealed cup design, are often branded as promotional materials. That is, a restaurant, hotel, or other supplier will print a trademark, service mark, logo, or the like on the dispensing container as a promotional and advertising tool. However, these prior art containers have been limited to printing only because of the configuration of the container.

Therefore, it can be seen that there is a need in the art for a dispensing container that is easy to open and allows control over the dispensing of the contents.

SUMMARY OF THE INVENTION

The present invention includes a container formed from a shell having container walls enclosing a chamber. The container walls are formed from a material that is somewhat stiff so that it may be formed into a container yet deformable such as a thermoplastic polymer, thermoset polymer, or the like. Optionally, the container walls of the shell may be thin-walled to minimize weight and allow deformation. In a further optional embodiment, the container walls may be formed into a three-dimensional form.

The container walls are substantially continuous with a small dispensing opening. In an optional embodiment, the container may additionally include a separate fill opening that may be used to fill the container and is covered or closed after filling the container.

The dispensing opening is covered by at least one protective cap to prevent leakage. Optionally, the cap bulges from the container to form an air pocket over the dispensing opening. The cap may be plastic, paper, or any other material that may be burst, ruptured, torn, or otherwise broken or removed from the dispensing container to expose the dispensing opening. In an optional embodiment, the container may additionally include a thin film substantially covering the dispensing opening to prevent leakage when the cap is ruptured. The thin film is optionally formed from a polymer sheet and has a thickness such that the film may be ruptured by applying pressure to the container contents by squeezing the container.

In a further optional embodiment, the dispensing container may include a sharp tooth between the cap and the film. The tooth is optionally connected to the cap. When pressure is applied to the cap, the cap, in turn, drives the tooth into the film thereby rupturing the film and release the contents of the dispensing container. The cap optionally includes a hollow channel through which the contents of the dispensing container may flow. In a further optional embodiment, the hollow channel extends through the tooth.

In use, the container is filled. Optionally, the container is filled though the fill opening and the fill opening is closed or otherwise sealed. In an embodiment lacking a tooth, the container is opened by rupturing or removing the cap to expose the film, if any. The cap is ruptured by squeezing or otherwise applying pressure to the air pocket or by tearing the cap. The film is then ruptured by squeezing the container to generate pressure on the film. The contents of the container are dispensed through the dispensing opening. In a further optional embodiment of the present invention, a means for producing a sound may be incorporated into the container and connected to an actuator sensing the rupture of the cap or the film or, alternatively, the squeezing of the container.

In an alternate embodiment including a tooth, the film is first ruptured by driving the tooth into the film then rupturing the cap or, alternatively, allowing the contents of the container to flow through a hollow channel in the cap.

It is an object of the present invention to provide a container that is easy to open and affords control over the dispensing of the contents.

DESCRIPTION

Figure 1:
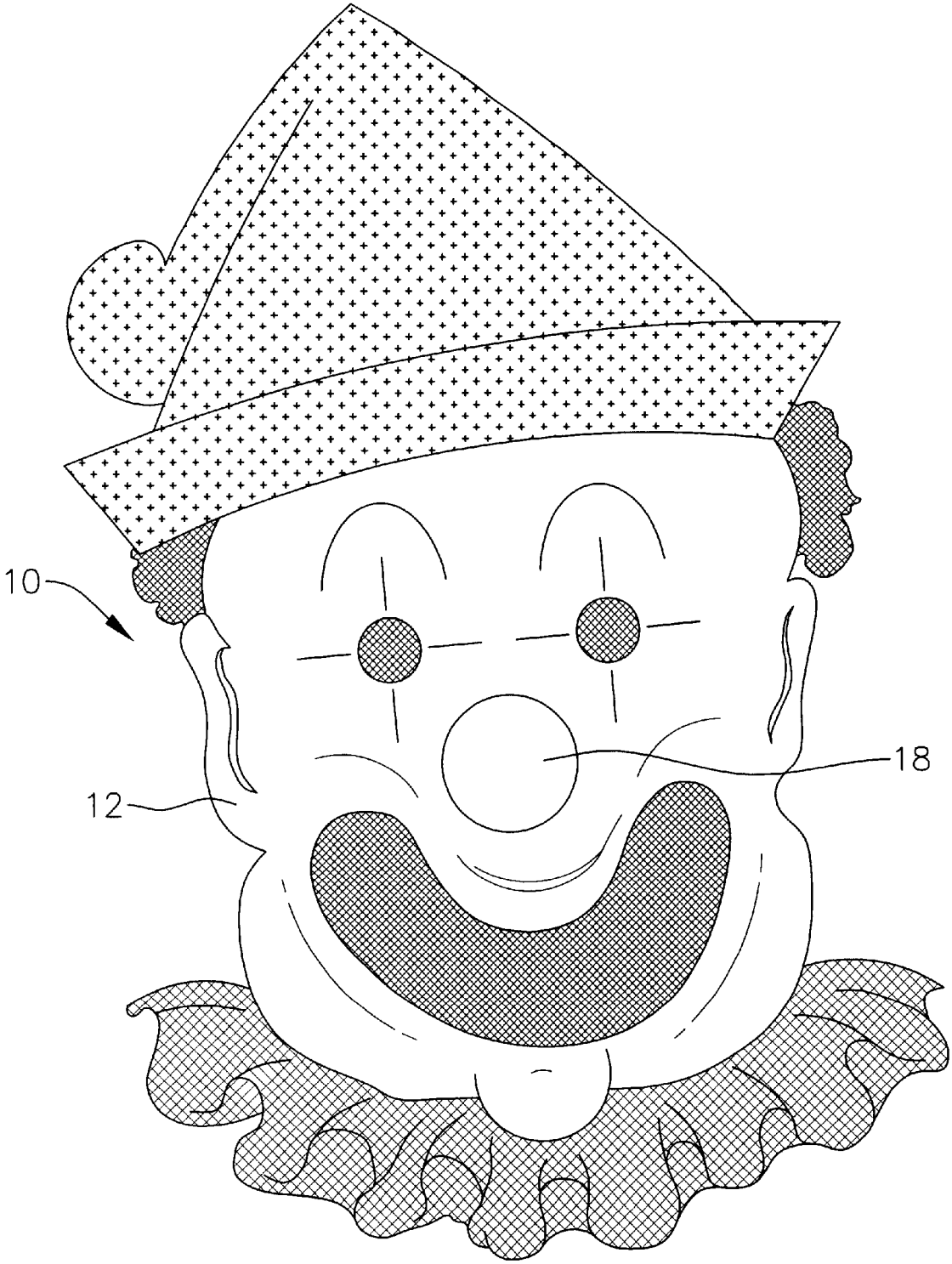
FIG. 1 is a front view of a container according to an embodiment of the present invention.
Figure 2:
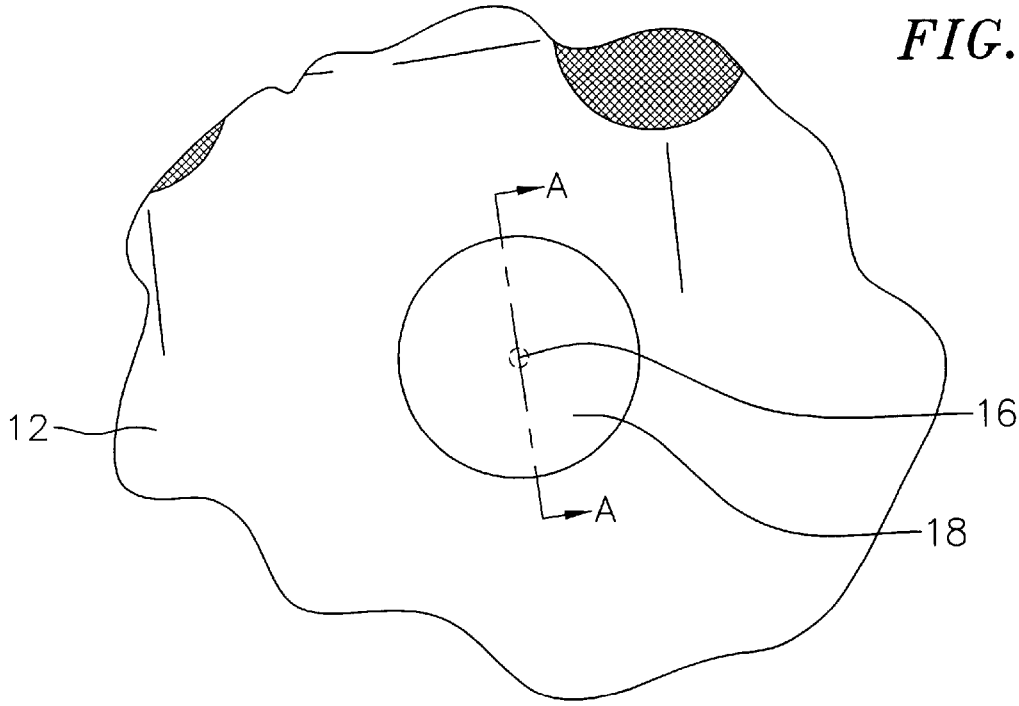
FIG. 2 is magnified, partial front view of the dispensing opening, cap, and film of FIG. 1.

Reference is now made to the figures wherein like parts are referred to by like numerals throughout. Referring to FIGS. 1–4, the dispensing container 10 of the present invention includes container walls 12 defining a shell surrounding and enclosing a chamber 14. The chamber 14 is adapted to hold a variety of materials including fluids, pastes, sprays, powders, and other flowable materials. For example, the dispensing container 10 of the present invention may be adapted to hold a variety of contents including foodstuffs, such as creamer, sugar, salt, pepper, ketchup or other condiments, liquor or other beverages, or the like; pharmaceuticals and toiletries, such as toothpaste, shampoo, mouthwash, perfume, medicine, or the like; novelties, such as novelty bubble fluid; or any other liquid, gas, paste, spray, powder, or the like.

The container walls 12 of the shell are optionally formed from a semi-rigid material that is deformable under pressure. Materials that have such characteristics include polymers, such as thermoplastic polymers or thermoset polymers, coated paper, such as wax paper or plastic coated paper, or a variety of other similar materials. If the dispensing container 10 contains fluids, the container walls 12 should have a porosity to prevent leakage.

As stated above, the dispensing container 10 defines a shell to surround and enclose a chamber 14. Optionally, the container walls 12 of the shell are formed such that the dispensing container 10, as a whole, is a three-dimensional representation. Specifically, the dispensing container 10 as a whole may take the appearance of a non-geometric, three-dimensional sculptural design such as the clown shown in FIG. 1. As a three-dimensional form, the dispensing container 10 may serve as a novelty and as an indicator of source in addition to its function as a dispensing container 10. That is, the form of the dispensing container 10 could represent the origin of the dispensing container 10. For example, restaurants or hotels could have dispensing containers 10 in the form of the restaurant or hotel logo. Likewise, schools could have dispensing containers 10 in the form of the school mascot, and so forth.

With reference to FIGS. 1–7, the container walls 12 of the present invention are substantially continuous except for a dispensing opening 16. The dispensing opening 16 is of a size to allow the contents to flow through the dispensing opening 16. In an optional embodiment, when used with liquids, the dispensing opening 16 is of a size to create a pressurized stream of liquid when the dispensing container 10 is squeezed. Thus, the area of the dispensing opening 16 is substantially smaller than the surface area of the container wall 12.

The dispensing opening 16 is covered by at least one cap 18 protecting the film 22 as discussed below. The cap 18 is formed from a material that may be deformed, torn or ruptured such as plastic, plastic-coated paper, paper, or the like. The cap 18 may be flexible, rigid, or semi-rigid. Because the dispensing container 10 of the present invention may be formed into a three-dimensional design, the cap 18 may optionally be incorporated into the design. In the example of FIG. 1, the cap 18 and the air pocket 20 formed thereby is the clown's nose. Alternatively or additionally, it is contemplated that the surface of the dispensing container 10 may be printed, embossed, labeled, or the like. For example, it is contemplated that a hologram image, optionally an animated hologram image, may be adhered to, or otherwise superimposed on, the surface of the dispensing container 10.

With specific reference to the optional embodiment of FIGS. 1–4, the cap 18 may form an air pocket 20 over the dispensing opening 16. In such an embodiment, the dispensing opening 16 is exposed by tearing the cap 18 or by exerting pressure on the air pocket 20 to rupture the cap 18. This pressure could be applied in a variety of ways including squeezing the air pocket 20 with the fingers or pressing the air pocket 20 against a hard surface such as a table top.

Figure 3:
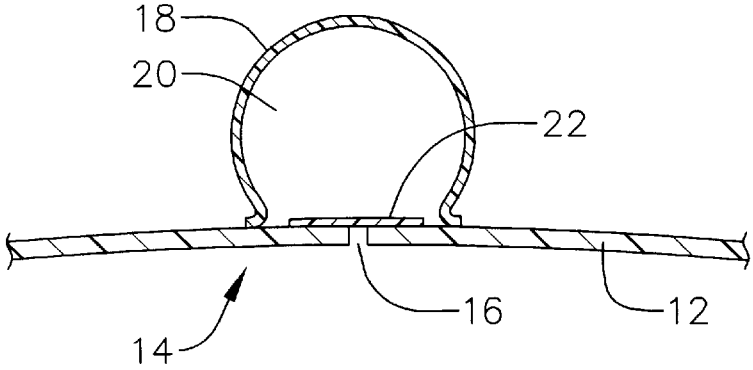
FIG. 3 is a cutaway side view of the dispensing opening, cap, and film taken along section line A—A of FIG. 2.
Figure 4:
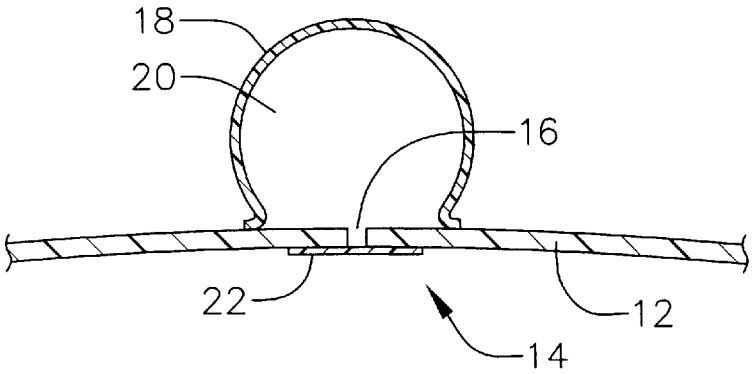
FIG. 4 is a cutaway side view of an alternate embodiment of the dispensing opening, cap, and film taken along section line A—A of FIG. 2.

With continued reference to the embodiment of FIGS. 1–4, in an optional embodiment, the dispensing container 10 further includes a thin film 22 substantially covering the dispensing opening 16. The thin, burstable film 22 may be on the outer surface of the container wall 12 as shown in FIG. 3, or, in the alternate embodiment shown in FIG. 4, secured to the inner surface of the container wall 12. The film 22 is of a material and a thickness such that the film 22 may be ruptured by pressurizing the contents of the dispensing container 10 as by squeezing the dispensing container 10. That is, the thickness of the film 22 is selected such that when pressure is applied to the container walls 12, the film 22 ruptures at a pressure lower than that required to rupture the container walls 12 forming the shell.

It is also contemplated that in an alternate embodiment, the film 22 may take the form of a plug (not shown) positioned inside the dispensing opening 16. Like the film 22, the plug would rupture or displace under pressure thereby allowing the contents to flow through the dispensing opening 16.

Figure 5:
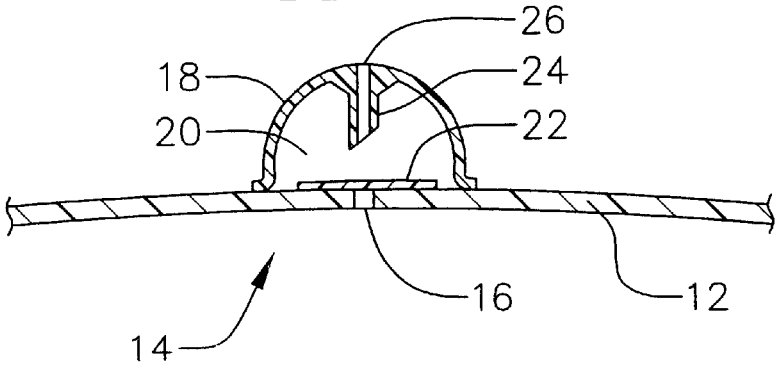
FIG. 5 is a cutaway side view of the dispensing opening, cap, tooth, and film taken along section line A—A of FIG. 2.
Figure 6:
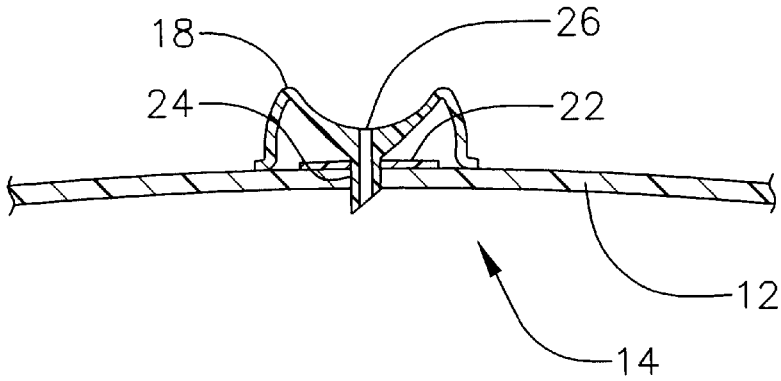
FIG. 6 is a cutaway side view of the dispensing opening, cap, tooth, and film taken along section line A—A of FIG. 2
Figure 7:
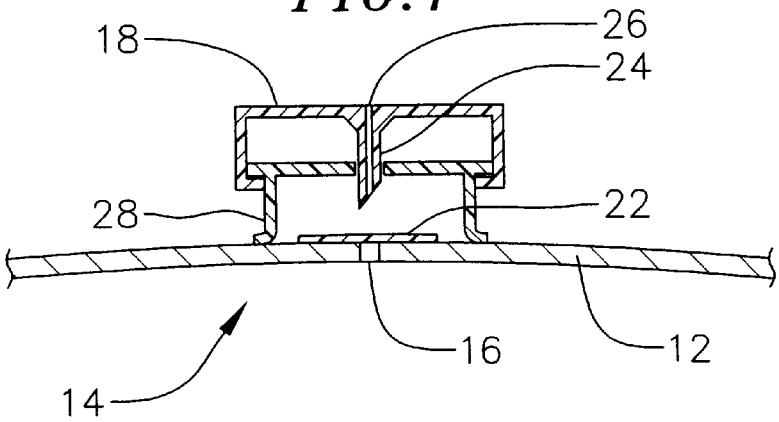
FIG. 7 is a cutaway side view of an alternate embodiment of the dispensing opening, cap, and film of the present invention.

With reference to the alternate embodiment in FIGS. 5 7, the dispensing container 10 includes tooth 24 disposed between the cap 18 and the film 22 substantially covering the dispensing opening 16. The tooth 24 is positioned above the dispensing opening 16 covered by the film 22. Optionally, the tooth 24 is mounted to the surface of the cap 18 opposite the film 22. Alternatively, the tooth 24 may be mounted on a lever (not shown) between the cap 18 and the film 22. In use, displacement or deformation of the cap 18 causes the cap 18 to drive the tooth 24 into the film 22. The tooth 24 ruptures or displaces the film 22 to thereby open the dispensing opening 16 and release the contents of the dispensing container 10. In an optional embodiment, the tooth 24 includes a hollow channel 26 or spout (not shown) there through to provide passage for, and direct the flow of, the contents of the dispensing container 10. Because a tooth 24 is provided to rupture the film 22, the film 22 of the embodiment of FIGS. 5–7 may be thicker than the film 22 of the embodiment of FIGS. 2–4. Again, it is contemplated that in an alternate embodiment, the film 22 may be replaced with a plug (not shown) positioned inside the dispensing opening 16. Like the film 22, the tooth 24 would rupture or displace the plug thereby allowing the contents to flow through the dispensing opening 16.

In yet another optional embodiment, shown in FIG. 7, the cap 18 may be slidably engaged to a mount 28. Disposed between the cap 18 and the film 22 is a tooth 24. To open the dispensing container 10, the cap 18 is displaced in a sliding fashion toward the film 22. As the cap 18 slides toward the film 22, the tooth 24 is driven into the dispensing opening 16 thereby rupturing or displacing the film 22. Again, the tooth 24 may include a hollow channel 26 therethrough to guide and direct the contents of the dispensing container 10.

In yet another embodiment, the cap 18, with a tooth 24 mounted thereon, may be pivotally secured to the lip of the dispensing container 10. In such an embodiment, the tooth 24 ruptures the film 22 when the cap 18 is pivoted and thereby creates an passage, for example a spout (not shown), that guides the contents of the dispensing container 10.

In an optional embodiment, the dispensing container 10 may additionally include a separate fill opening (not shown). Such a fill opening may be covered with a permanent or removable cover after the dispensing container 10 is filled. In an embodiment where the fill opening cover is removable, the fill opening may also be used to dispense the contents of the dispensing container 10.

Another optional feature is a means for generating a sound, such as a microchip or the like, communicating with an actuator that senses the rupture of the cap 18 or the film 22 or the application of pressure to the dispensing container 10. Upon sensing such an event, the actuator causes the sound generating means to generate a sound.

Referring to FIGS. 1–7, in use, the dispensing container 10 is filled. In an embodiment including a fill hole, the contents are injected through the fill hole into the dispensing container 10. Alternatively, the dispensing container 10 may include a plurality of segments so that a segment of the dispensing container 10 may be filled, then fused to the remaining segments. In yet another optional embodiment, dispensing container 10 may be filled through the dispensing opening 16. Once filled, the dispensing container 10 is sealed by plugging the fill opening, fusing a segment to close the fill opening, or in an embodiment in which the dispensing container 10 is filled through the dispensing opening 16, by covering the dispensing opening 16 with the film 22 or cap 18.

In an alternate embodiment of the present invention, the cap 18 may be manufactured separately from the dispensing container 10. The dispensing container 10 may be filled through a fill hole that is covered by the film 22; The cap 18 is then fused, adhered, mechanically fastened, or otherwise secured over the film 22. For example, engaging fasteners may be provided on the dispensing container 10 and the cap 18 that engage, for example in a snap fit, when the cap 18 and dispensing container 10 are pressed together.

With reference to FIGS. 1–4, to open the dispensing container 10, the dispensing opening 16 is exposed by tearing or rupturing the film 22 and then opening the cap 18, if necessary. In the embodiments shown in FIGS. 3 and 4, in which the cap 18 forms an air pocket 20 over the dispensing opening 16, the cap 18 may be ruptured by squeezing, or otherwise applying pressure to, the air pocket 20. As pressure builds in the air pocket 20, the cap 18 stretches and eventually ruptures. The film 22, if any, is ruptured by applying pressure to the contents of the dispensing container 10 such as by squeezing the dispensing container 10.

Alternatively, in the embodiments of FIGS. 5–7, in which a tooth 24 is provided, the cap 18 is driven toward the film 22 by deforming, sliding, pivoting, or the like. The tooth 24 ruptures the film 22 as the cap 18 drives the tooth 24 through the dispensing opening 16. If the cap 18 includes a hollow channel 26 therethrough, the contents may be squeezed through the hollow channel,26. Otherwise, the cap 18 may need to be ruptured to free the contents.

After the film 22 is ruptured, the contents of the dispensing container 10 may be forced from the dispensing container 10 by pouring the contents from the dispensing container 10 or by squeezing the deformable dispensing container 10. When the dispensing container 10 is used to hold and dispense liquid, a steady stream may be created by applying steady pressure to the dispensing container 10. For example, if the cap 18 includes a hollow channel 26, the channel 26 may guide the contents of the container 10 as the deformable container 10 is squeezed.

While certain embodiments of the present invention have been shown and described it is to be understood that the present invention is subject to many modifications and changes without departing from the spirit and scope of the claims presented herein.

What is claimed is:

1. A single use dispensing container comprising:

a substantially continuous shell having a dispensing opening covered by a film; and a substantially continuous cap frangible under applied pressure fixed to said shell covering said dispensing opening to cooperate with said shell to form an air pocket, the thickness of said cap selected such that said cap selectively and permanently ruptures under pressure applied to said cap at a lower pressure than the pressure required to cause said shell to rupture, such that when the cap is squeezed, the cap permanently ruptures to expose said film covering said dispensing opening.

2. The dispensing container of claim 1 further comprising a tooth secured to said cap, said cap movable with respect to said shell such that said tooth may be driven from a position spaced from said film to a position in which said tooth pierces said film.

3. A single use dispensing container comprising:

a deformable shell having a dispensing opening;

a burstable film fixed to said shell covering said dispensing opening; and a substantially continuous cap frangible under applied pressure secured to said shell overlying said film, such that when the cap is squeezed, the cap permanently ruptures to expose said film covering said dispensing opening, thereby permitting the film to be opened to expose the dispensing opening.

4. The dispensing container of claim 3 wherein said cap is movable with respect to said shell, further comprising a tooth fixed to said cap positioned between said cap and said film such that said tooth ruptures said film when said cap is moved toward said dispensing opening.

5. The dispensing container of claim 4 wherein said cap includes a channel therethrough defining a spout for said dispensing opening.

6. The dispensing container of claim 3 wherein said cap is deformable with respect to said shell, further comprising a tooth fixed to said cap positioned between said cap and said film such that said tooth ruptures said film when said cap is deformed toward said dispensing opening.

7. The dispensing container of claim 6 wherein said cap includes a channel therethrough defining a spout for said dispensing opening.

8. The dispensing container of claim 3 wherein said cap and said film cooperate to form a sealed air pocket between said cap and said film.

9. The dispensing container of claim 3 wherein said shell and cap cooperate to form a non-geometric, three-dimensional sculptural design.

10. A single use dispensing container comprising:

a shell having a dispensing opening;

a film fixed to said shell covering said dispensing opening;

a substantially continuous cap frangible under applied pressure secured to said shell overlying said film, said cap displaceable with respect to said shell; and a tooth fixed to said cap positioned between said cap and said film such that said tooth pierces said film when said cap is displaced toward said dispensing opening, such that the dispensing opening is exposed by displacing said cap toward said film to pierce said film with said tooth and applying pressure to said cap to cause said cap to permanently rupture.

11. The dispensing container of claim 10 wherein said cap includes a channel therethrough defining a spout for said dispensing opening.

12. The dispensing container of claim 10 wherein said shell and cap cooperate to form a non-geometric, three-dimensional sculptural design.

13. A single use dispensing container comprising:

a deformable shell having a dispensing opening;

a burstable film fixed to said shell covering said dispensing opening, said film thickness selected such that said film selectively and permanently ruptures under pressure applied to said deformable shell at a lower pressure than the pressure required to cause said deformable shell to rupture; and a substantially continuous cap frangible under applied pressure secured to said shell overlying said film forming a sealed air pocket between said cap and said film, such that when the cap is squeezed, the increased pressure in said air pocket causes said cap to selectively and permanently rupture to expose said film covering said dispensing opening, thereby permitting the film to be opened to expose the dispensing opening.

14. The dispensing container of claim 13 wherein said shell and cap cooperate to form a non-geometric, three-dimensional sculptural design.

15. A single use dispensing container comprising:

a shell having a dispensing opening;

a film fixed to said shell covering said dispensing opening;

a substantially continuous cap frangible under applied pressure secured to said shell overlying said film, said cap deformable with respect to said shell; and a tooth fixed to said cap positioned between said cap and said film such that said tooth pierces said film when said cap is displaced toward said dispensing opening, such that the dispensing opening is exposed by deforming said cap toward said film to pierce said film with said tooth and applying pressure to said cap to cause said cap to permanently rupture.

16. The dispensing container of claim 15 wherein said cap includes a channel therethrough defining a spout for said dispensing opening.

17. The dispensing container of claim 15 wherein said shell and cap cooperate to form a non-geometric, three-dimensional sculptural design.

18. A single use dispensing container comprising:

a deformable shell having a dispensing opening;

a burstable film fixed to said shell covering said dispensing opening, said film thickness selected such that said film selectively and permanently ruptures under pressure applied to said deformable shell at a lower pressure than the pressure required to cause said deformable shell to rupture; and a substantially continuous cap frangible under applied pressure secured to said shell overlying said film forming a sealed air pocket between said cap and said film, such that when the cap is squeezed, the increased pressure in said air pocket causes said cap to selectively and permanently rupture to expose said film covering said dispensing opening, thereby permitting the film to be opened to expose the dispensing opening.

19. The dispensing container of claim 18 wherein said shell and cap cooperate to form a non-geometric, three-dimensional sculptural design.

* * * * *